US008539917B2

(12) United States Patent
Lee

(10) Patent No.: US 8,539,917 B2
(45) Date of Patent: Sep. 24, 2013

(54) VARIABLE COMPRESSION RATIO APPARATUS

(75) Inventor: Eun Ho Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 276 days.

(21) Appl. No.: 13/180,180

(22) Filed: Jul. 11, 2011

(65) Prior Publication Data

US 2012/0118270 A1 May 17, 2012

(30) Foreign Application Priority Data

Nov. 16, 2010 (KR) ..... 10-2010-0113838

(51) Int. Cl.
*F02B 75/04* (2006.01)

(52) U.S. Cl.
USPC ..... 123/48 B; 123/78 BA

(58) Field of Classification Search
USPC ..... 123/48 R, 48 B, 78 R, 78 B, 78 BA, 123/78 E
See application file for complete search history.

(56) References Cited

FOREIGN PATENT DOCUMENTS

| | | | |
|---|---|---|---|
| JP | 06-212993 | A | 8/1994 |
| KR | 20050032661 | A | 4/2005 |
| WO | WO 96/27079 | A1 | 9/1996 |

*Primary Examiner* — Noah Kamen
(74) *Attorney, Agent, or Firm* — Morgan, Lewis & Bockius LLP

(57) ABSTRACT

A variable compression ratio apparatus may be mounted at an engine receiving combustion force of an air-fuel mixture from a piston and rotating a crankshaft, and may change compression ratio of the air-fuel mixture. The variable compression ratio apparatus includes a connecting rod having a small end and a big end, the small end being formed of an eccentric bearing hole concentrically so as to be rotatably connected to the piston through a piston pin, and the crankshaft is rotatably mounted at the big end, an eccentric link having one end to which an eccentric bearing rotatably mounted in the eccentric bearing hole concentrically is connected, an eccentric link slot being formed along a length direction thereof, a variable bar formed of a variable bar gear at one end portion thereof, and connected to the eccentric link through a variable bar pin movable along the eccentric link slot, and a variable gear engaged with the variable bar gear so as to move the variable bar to a predetermined direction reciprocally, wherein a piston pin hole is formed at the eccentric bearing eccentrically, and the piston pin is inserted in the piston pin hole such that the piston, the connecting rod, and the eccentric link are rotatably connected to each other.

10 Claims, 2 Drawing Sheets

VARIABLE COMPRESSION RATIO APPARATUS

CROSS-REFERENCE TO RELATED APPLICATION

This application claims priority to and the benefit of Korean Patent Application No. 10-2010-0113838 filed Nov. 16, 2010, the entire contents of which application is incorporated herein for all purposes by this reference.

BACKGROUND OF INVENTION

1. Field of Invention

The present invention relates to a variable compression ratio apparatus. More particularly, the present invention relates to a variable compression ratio apparatus which changes compression ratio of an air-fuel mixture in a combustion chamber according to a driving condition of an engine.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

According to a conventional variable compression ratio apparatus, a variable compression ratio is achieved by changing a length of a connecting rod which connects a piston to a crankshaft. Such types of a variable compression ratio apparatus include a plurality of links connecting a piston with the crankshaft, and combustion force is directly transmitted to the links. So, durability of the links deteriorates.

It becomes known to a person skilled in the art through various experimental results conducted to a conventional variable compression ratio apparatus that operation reliability is high in a case that a distance between a crank pin and a piston pin is changed by using an eccentric bearing. If hydraulic pressure, however, is used for rotating the eccentric bearing, a rotating angle of the eccentric bearing in each cylinder or hydraulic pressure applied to each cylinder is different. So, a compression ratio in a cylinder is different from that in another cylinder and a time required for changing the compression ratio according to the driving condition of the engine is varied in each cylinder.

Since a plurality of links is used for rotating the eccentric bearing, moving mass may increase. Therefore, load applied to the eccentric bearing becomes increase and balance weight becomes heavier.

Further, since additional space for mounting the plurality of links is necessary at one side portion of the engine, installability of the engine may be deteriorated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a variable compression ratio apparatus having advantages of reducing moving mass as a consequence of minimizing the number of links for rotating an eccentric bearing.

Various aspects of the present invention provide for a variable compression ratio apparatus which can be mounted at an engine without increasing a volume thereof is provided.

Various aspects of the present invention provide for a variable compression ratio apparatus in which link members for rotating a connecting rod and link members for rotating an eccentric bearing are kinematically separated and combustion force of air-fuel mixture delivered to the link members can be minimized is provided.

A variable compression ratio apparatus according to various aspects of the present invention may be mounted at an engine receiving combustion force of an air-fuel mixture from a piston and rotating a crankshaft, and may change compression ratio of the air-fuel mixture. The variable compression ratio apparatus including a connecting rod having a small end and a big end, the small end being formed of an eccentric bearing hole concentrically so as to be rotatably connected to the piston through a piston pin, and the crankshaft is rotatably mounted at the big end, an eccentric link having one end to which an eccentric bearing rotatably mounted in the eccentric bearing hole concentrically is connected, an eccentric link slot being formed along a length direction thereof, a variable bar formed of a variable bar gear at one end portion thereof, and connected to the eccentric link through a variable bar pin movable along the eccentric link slot, and a variable gear engaged with the variable bar gear so as to move the variable bar to a predetermined direction reciprocally, wherein a piston pin hole is formed at the eccentric bearing eccentrically, and the piston pin is inserted in the piston pin hole such that the piston, the connecting rod, and the eccentric link are rotatably connected to each other.

In a case that the variable bar moves to the predetermined direction, the variable bar pin may move along the eccentric link slot so as to rotate the eccentric link.

The eccentric bearing may be integrally formed with the eccentric link.

The piston may be adapted to move upwardly or downwardly in a cylinder block liner, and the crankshaft may be adapted to rotate in a crank case. A sliding groove may be formed horizontally at a connecting portion of the cylinder block liner and the crank case such that the variable bar is movable in the sliding groove horizontally.

The variable compression ratio apparatus may further include an actuator, wherein the variable gear is rotated according to a driving condition of the engine by the actuator.

A variable compression ratio apparatus according to other aspects of the present invention may include a connecting rod having one end connected to the piston and the other end connected to the crankshaft so as to deliver the combustion force of the air-fuel mixture to the crankshaft, an eccentric link having one end to which an eccentric bearing mounted at the one end of the connecting rod is connected and an eccentric link slot formed along a length direction thereof, a piston pin eccentrically mounted at the one end of the connecting rod and the eccentric bearing so as to connect the connecting rod, the eccentric bearing, and the piston, and changes a distance between a center of the eccentric bearing and an upper end of the piston according to a rotation of the eccentric bearing, a variable bar formed of a variable bar gear at one end portion thereof, a variable gear engaged to the variable bar gear so as to move the variable bar to a predetermined direction reciprocally, and a variable bar pin connecting the variable bar with the eccentric link slot, and moving along the eccentric link slot so as to rotate the eccentric bearing in a case that the variable bar moves to the predetermined direction.

The eccentric bearing may be inserted in an eccentric bearing hole formed at the one end of the connecting rod concentrically, and the piston pin may be inserted in a piston pin hole formed at the eccentric bearing eccentrically.

The eccentric bearing may be integrally formed with the eccentric link.

The piston may be adapted to move upwardly or downwardly in a cylinder block liner, and the crankshaft may be adapted to rotate in a crank case. A sliding groove may be formed horizontally at a connecting portion of the cylinder block liner and the crank case such that the variable bar is movable in the sliding groove horizontally.

The variable compression ratio apparatus may further include an actuator, wherein the variable gear is rotated according to a driving condition of the engine by the actuator.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
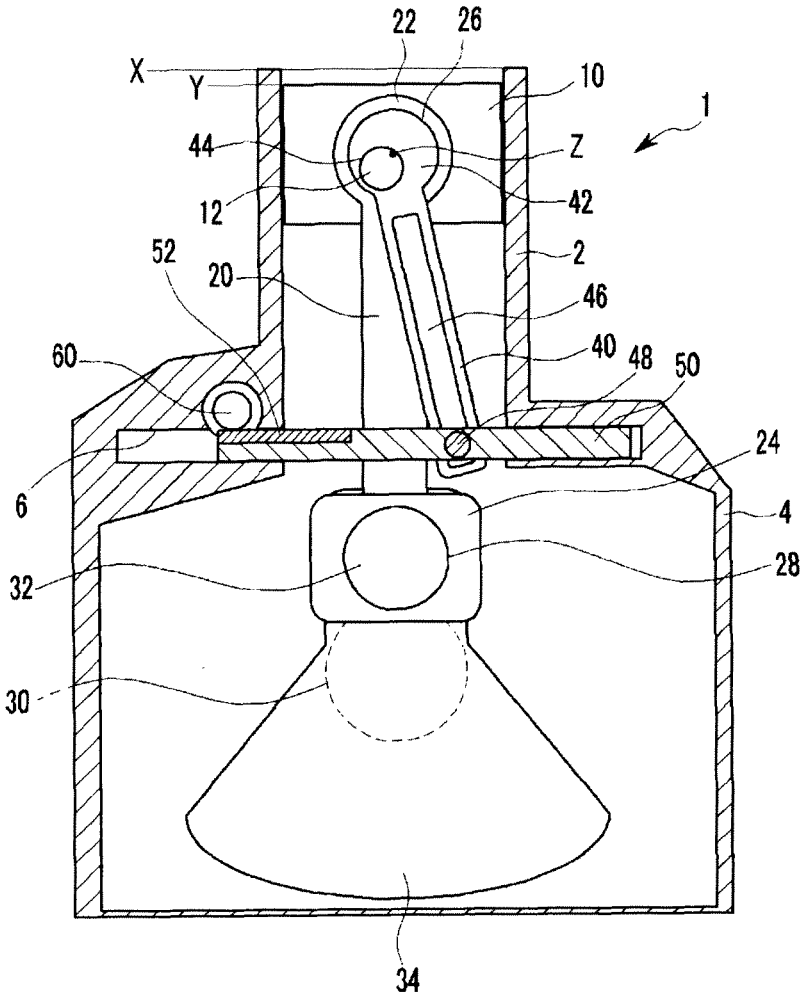
FIG. 1 is a cross-sectional view of an exemplary variable compression ratio apparatus according to the present invention which is operated at a low compression ratio.
Figure 2:
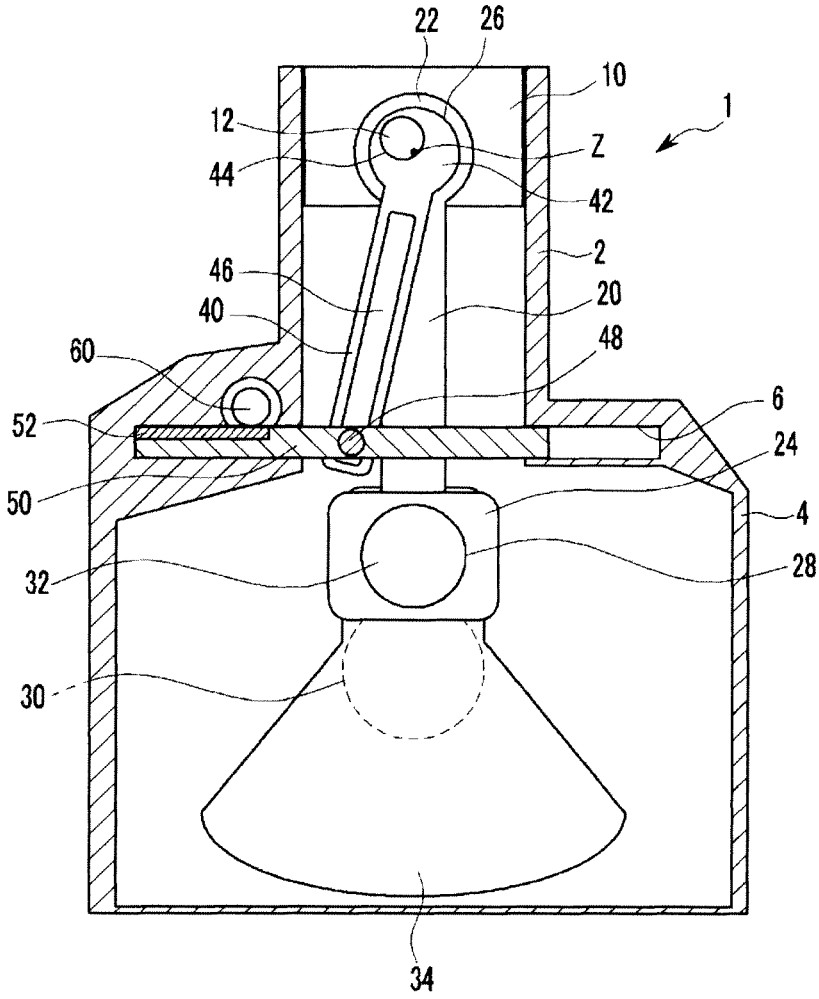
FIG. 2 is a cross-sectional view of an exemplary variable compression ratio apparatus according to the present invention which is operated at a high compression ratio.

As shown in FIG. 1 and FIG. 2, a variable compression ratio apparatus 1 according to various embodiments of the present invention is mounted at an engine which receives combustion force of air-fuel mixture from a piston 10 and rotates a crankshaft 30. The variable compression ratio apparatus 1 changes compression ratio of the air-fuel mixture according to a driving condition of the engine.

The engine includes a cylinder block liner 2 and a crank case 4, and the crank case 4 is coupled to a lower portion of the cylinder block liner 2. A sliding groove 6 is formed horizontally at a connecting portion of the cylinder block liner 2 and the crank case 4.

The piston 10 is installed in the cylinder block liner 2 and moves upwardly or downwardly in the cylinder block liner 2 by the combustion force of the air-fuel mixture. A combustion chamber is formed between the piston 10 and the cylinder, and the air-fuel mixture is flowed into the combustion chamber and is burned.

The crankshaft 30 receives the combustion force from the piston 10 and converts the combustion force into torque so as to deliver it to a transmission. The crankshaft 30 is mounted in the crank case 4. The crankshaft 30 includes a crank pin 32 formed eccentrically to the crankshaft 30. In addition, a plurality of balance weights 34 is mounted at the crankshaft 30. The balance weights 34 reduce rotation vibration that occurs when the crankshaft 30 rotates.

The variable compression ratio apparatus 1 includes a connecting rod 20, an eccentric link 40, a variable bar 50, and a variable gear 60.

The connecting rod 20 receives the combustion force from the piston 10 and delivers the combustion force to the crankshaft 30. The connecting rod 20 according to various embodiments of the present invention is similar to a conventional connecting rod. That is, the connecting rod 20 includes a small end 22 at an upper portion thereof and a big end 24 at a lower portion thereof. The small end 22 is rotatably connected to the piston 10 through a piston pin 12, and the big end 24 is rotatably connected to the crank pin 32 formed eccentrically to the crankshaft 30. For this purpose, an eccentric bearing hole 26 is formed at the small end 22 concentrically, and a crank pin hole 28 is formed at the big end 24 such that the crank pin 32 is rotatably inserted in the crank pin hole 28. Since the connecting rod 20 similar to the conventional connecting rod is used, a structure of a conventional engine may not be changed so as to mount the variable compression ratio apparatus. In addition, durability of link members forming the variable compression ratio apparatus may be improved by transmitting the combustion force of the air-fuel mixture mostly to the connecting rod 20.

One end of the eccentric link 40 is rotatably connected to the small end 22 of the connecting rod 20. For this purpose, an eccentric bearing 42 is connected to one end of the eccentric link 40, and the eccentric bearing 42 is inserted in the eccentric bearing hole 26 concentrically. A piston pin hole 44 is formed eccentrically to the eccentric bearing 42 at the eccentric bearing 42. The piston pin 12 is inserted in the piston pin hole 44 so as to rotatably connect the connecting rod 20 and the eccentric link 40 to the piston 10. That is, a center axis of the eccentric bearing 42 (the same as a center axis of the eccentric bearing hole 26) is parallel with and is spaced by a predetermined distance from a center axis of the piston pin 12. Therefore, if the eccentric bearing 42 rotates, a relative position of a center of the piston pin 12 to a center of the eccentric bearing hole 26 is changed. Thereby, a distance between a center Z of the eccentric bearing 42 and an upper end Y of the piston 10 is changed. Therefore, a position of the piston pin 12 to the crank pin 32 is changed and the compression ratio of the air-fuel mixture is changed. In this specification, the eccentric bearing 42 is integrally formed and/or monolithically formed with the eccentric link 40, but is not limited to this. That is, the eccentric bearing 42 can be separately manufactured and be assembled to the eccentric link 40.

In addition, an eccentric link slot 46 is formed at the eccentric link 40 along a length direction thereof.

The variable bar 50 is movably inserted in the sliding groove 6 formed at the connecting portion of the cylinder block liner 2 and the crank case 4. A variable bar gear 52 is formed at one end portion of the variable bar 50. A variable bar pin 48 is mounted at a middle portion of the variable bar 50 and is adapted to move along the eccentric link slot 46. That is, the variable bar pin 48 connects the variable bar 50 with the eccentric link 40 such that the variable bar 50 and the eccentric link 40 can move relatively. Therefore, if the variable bar 50 moves horizontally in the sliding groove 6, the variable bar pin 48 moves along the eccentric link slot 46 and rotates the eccentric link 40.

The variable gear 60 is mounted at the connecting portion of the cylinder block liner 2 and the crank case 4 and engages with the variable bar gear 52. The variable gear 60 rotates according to the driving condition of the engine so as to move the variable bar 50 horizontally. In addition, the variable gear 60 is connected to an actuator such as a motor, and operation of the actuator is controlled by a control portion. Therefore, if the control portion decides the compression ratio of the air-fuel mixture according to the driving condition of the engine, the control portion operates the actuator. The variable gear 60 rotates by the operation of the actuator and changes the compression ratio of the air-fuel mixture.

Hereinafter, operation of the variable compression ratio apparatus 1 according to various embodiments of the present invention will be described in detail.

As shown in FIG. 1, in a case that the variable compression ratio apparatus 1 operates at a low compression ratio, an upper end Y of the piston 10 is lower than that X of the cylinder block liner 2 at a top dead center (TDC). At this state, if the control portion rotates the variable gear 60 and moves the variable bar 50 to the left in the drawings, the variable bar pin 48 moves along the eccentric link slot 46 and rotates the eccentric link 40 clockwise. Accordingly, a position of the piston pin 12 is heightened and a high compression ratio is realized as shown in FIG. 2.

If the control portion rotates the variable gear 6 and moves the variable bar 50 to the right in the drawings in a state that the variable compression ratio apparatus 1 operates at the high compression ratio as shown in FIG. 2, the variable bar pin 48 moves along the eccentric link slot 46 and rotates the eccentric link 40 counterclockwise. Accordingly, the position of the piston pin 12 is lowered and the low compression ratio is realized as shown in FIG. 1.

In order to mount the variable compression ratio apparatus 1 according to various embodiments of the present invention to the engine, only the sliding groove 6 may be formed horizontally. Therefore, structure and volume of the engine is hardly changed. That is, the variable compression ratio apparatus 1 according to various embodiments of the present invention can be applied to a conventional engine easily.

As described above, since an eccentric link and a variable bar move so as to rotate an eccentric bearing, moving mass may be minimized according to various embodiments of the present invention. Therefore, load applied to the eccentric bearing may be reduced and weight of a balance weight need not to increase.

In addition, a variable compression ratio apparatus may be mounted at an engine by forming a sliding groove at a connecting portion of a cylinder block liner and a crank case. Therefore, volume of the engine may not increase and the variable compression ratio apparatus can be easily mounted without a change in structure of a conventional engine.

Furthermore, durability of link members may be improved by directly delivering combustion force of air-fuel mixture to a connecting rod.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus for an engine receiving combustion force of an air-fuel mixture from a piston and a rotating crankshaft, and which changes compression ratio of the air-fuel mixture, the variable compression ratio apparatus comprising:

a connecting rod including a small end and a big end, the small end being formed of an eccentric bearing hole concentrically rotatably connected to the piston through a piston pin, and the crankshaft is rotatably mounted at the big end;

an eccentric link including one end supporting an eccentric bearing rotatably mounted in the eccentric bearing hole, an eccentric link slot extending along a longitudinal direction thereof;

a variable bar including a variable bar gear at one end, and connected to the eccentric link by a variable bar pin movably received along the eccentric link slot; and a variable gear engaged with the variable bar gear to reciprocally move the variable bar to a predetermined direction;

wherein the eccentric bearing includes an eccentric piston pin hole, and the piston pin is inserted in the piston pin hole rotatably interconnecting the piston, the connecting rod, and the eccentric link.

2. The variable compression ratio apparatus of claim 1, wherein the variable bar pin moves along the eccentric link slot when the variable bar moves in the predetermined direction to rotate the eccentric link.

3. The variable compression ratio apparatus of claim 1, wherein the eccentric bearing is integrally formed with the eccentric link.

4. The variable compression ratio apparatus of claim 1, wherein the piston moves upwardly and downwardly in a cylinder block liner, and the crankshaft rotates in a crank case, and wherein a sliding groove extends across a connecting portion of the cylinder block liner and the crank case such that the variable bar is movable in the sliding groove.

5. The variable compression ratio apparatus of claim 1, further comprising an actuator, wherein the variable gear is rotated according to a driving condition of the engine by the actuator.

6. A variable compression ratio apparatus for an engine receiving combustion force of an air-fuel mixture from a piston and a rotating crankshaft, and which changes compression ratio of the air-fuel mixture, the variable compression ratio apparatus comprising:

a connecting rod including one end connected to the piston and another end connected to the crankshaft so as to deliver the combustion force of the air-fuel mixture to the crankshaft;

an eccentric link including one end supporting an eccentric bearing rotatably mounted at the one end of the connecting rod and including an eccentric link slot extending along a longitudinal direction thereof;

a piston pin eccentrically disposed at the one end of the connecting rod interconnecting the connecting rod, the eccentric bearing, and the piston, wherein the piston pin changes a distance between a center of the eccentric bearing and an upper end of the piston according to a rotation of the eccentric bearing;

a variable bar including a variable bar gear at one end thereof;

a variable gear engaged with the variable bar gear to reciprocally move the variable bar to a predetermined direction; and a variable bar pin connecting the variable bar with the eccentric link slot, and moving along the eccentric link slot so as to rotate the eccentric bearing when the variable bar moves in the predetermined direction.

7. The variable compression ratio apparatus of claim 6, wherein the eccentric bearing is inserted in an eccentric bearing hole concentrically formed at the one end of the connecting rod, and the piston pin is inserted in a piston pin hole eccentrically formed at the eccentric bearing.

8. The variable compression ratio apparatus of claim 6, wherein the eccentric bearing is integrally formed with the eccentric link.

9. The variable compression ratio apparatus of claim 6, wherein the piston is adapted to move upwardly and downwardly in a cylinder block liner, and the crankshaft is adapted to rotate in a crank case, and wherein a sliding groove extends across a connecting portion of the cylinder block liner and the crank case such that the variable bar is movable in the sliding groove.

10. The variable compression ratio apparatus of claim 6, further comprising an actuator, wherein the variable gear is rotated according to a driving condition of the engine by the actuator.

* * * * *